US011563275B2

(12) United States Patent
Wei

(10) Patent No.: US 11,563,275 B2
(45) Date of Patent: Jan. 24, 2023

(54) ANTENNA STRUCTURE

(71) Applicant: Wistron NeWeb Corp., Hsinchu (TW)

(72) Inventor: Shih-Chiang Wei, Hsinchu (TW)

(73) Assignee: WISTRON NEWEB CORP., Hsinchu (TW)

( * ) Notice: Subject to any disclaimer, the term of this patent is extended or adjusted under 35 U.S.C. 154(b) by 171 days.

(21) Appl. No.: 17/010,219

(22) Filed: Sep. 2, 2020

(65) Prior Publication Data

US 2021/0249776 A1 Aug. 12, 2021

(30) Foreign Application Priority Data

Feb. 6, 2020 (TW) ..... 109103648

(51) Int. Cl.
*H01Q 13/10* (2006.01)
*H01Q 1/48* (2006.01)

(52) U.S. Cl.
CPC ..... *H01Q 13/106* (2013.01); *H01Q 1/48* (2013.01)

(58) Field of Classification Search
CPC ..... H01Q 5/364; H01Q 5/357; H01Q 13/106; H01Q 5/328; H01Q 5/335; H01Q 5/392
See application file for complete search history.

(56) References Cited

U.S. PATENT DOCUMENTS

2010/0103062 A1* 4/2010 Chang ..... H01Q 13/10 343/767
2012/0268328 A1* 10/2012 Kim ..... H01Q 1/48 343/702
2015/0123874 A1* 5/2015 Chan ..... H01Q 5/30 343/905
2015/0207219 A1* 7/2015 Oh ..... H01Q 1/50 343/702
2016/0211570 A1* 7/2016 Jin ..... H01Q 5/314
2017/0054196 A1* 2/2017 Hu ..... H01Q 1/243
2017/0207542 A1* 7/2017 Tseng ..... H01Q 13/10
2020/0168993 A1 5/2020 Wei
2020/0328520 A1* 10/2020 Deng ..... H01Q 9/0457
2021/0376452 A1* 12/2021 Wu ..... H01Q 5/40

FOREIGN PATENT DOCUMENTS

TW I682582 B 1/2020

* cited by examiner

*Primary Examiner* — Ricardo I Magallanes
(74) *Attorney, Agent, or Firm* — McClure, Qualey & Rodack, LLP

(57) ABSTRACT

An antenna structure includes a metal mechanism element, a dielectric substrate, a feeding radiation element, a coupling radiation element, a ground plane, a first shorting element, a second shorting element, and a circuit element. The metal mechanism element has a slot. The dielectric substrate has a first surface and a second surface which are opposite to each other. The feeding radiation element extends across the slot. The coupling radiation element is adjacent to the feeding radiation element. The first shorting element is coupled to a first grounding point on the ground plane. The second shorting element is coupled to the metal mechanism element. The circuit element is coupled between the first shorting element and the second shorting element. The coupling radiation element is disposed on the first surface of the dielectric substrate. The feeding radiation element is disposed on the second surface of the dielectric substrate.

18 Claims, 7 Drawing Sheets

ANTENNA STRUCTURE

CROSS REFERENCE TO RELATED APPLICATIONS

This application claims priority of Taiwan Patent Application No. 109103648 filed on Feb. 6, 2020, the entirety of which is incorporated by reference herein.

BACKGROUND OF THE INVENTION

Field of the Invention

The disclosure generally relates to an antenna structure, and more particularly, it relates to a wideband antenna structure.

Description of the Related Art

With the advancements being made in mobile communication technology, mobile devices such as portable computers, mobile phones, multimedia players, and other hybrid functional portable electronic devices have become more common. To satisfy user demand, mobile devices can usually perform wireless communication functions. Some devices cover a large wireless communication area; these include mobile phones using 2G, 3G, and LTE (Long Term Evolution) systems and using frequency bands of 700 MHz, 850 MHz, 900 MHz, 1800 MHz, 1900 MHz, 2100 MHz, 2300 MHz, and 2500 MHz. Some devices cover a small wireless communication area; these include mobile phones using Wi-Fi and Bluetooth systems and using frequency bands of 2.4 GHz, 5.2 GHz, and 5.8 GHz.

Antennas are indispensable elements for wireless communication. If an antenna used for signal reception and transmission has insufficient bandwidth, the communication quality of the mobile device will suffer. Accordingly, it has become a critical challenge for antenna designers to design a small wideband antenna element.

BRIEF SUMMARY OF THE INVENTION

In an exemplary embodiment, the disclosure is directed to an antenna structure that includes a metal mechanism element, a dielectric substrate, a feeding radiation element, a coupling radiation element, a ground plane, a first shorting element, a second shorting element, and a circuit element. The metal mechanism element has a slot. The slot has a first closed end and a second closed end. The dielectric substrate has a first surface and a second surface which are opposite to each other. The feeding radiation element is coupled to a signal source. The feeding radiation element extends across the slot. The coupling radiation element is adjacent to the feeding radiation element. The ground plane is coupled to the metal mechanism element. The first shorting element is coupled to a first grounding point on the ground plane. The second shorting element is coupled to the metal mechanism element. The circuit element is coupled between the first shorting element and the second shorting element. The coupling radiation element is disposed on the first surface of the dielectric substrate. The feeding radiation element is disposed on the second surface of the dielectric substrate.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

In order to illustrate the purposes, features and advantages of the invention, the embodiments and figures of the invention are shown in detail as follows.

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". The term "substantially" means the value is within an acceptable error range. One skilled in the art can solve the technical problem within a predetermined error range and achieve the proposed technical performance. Also, the term "couple" is intended to mean either an indirect or direct electrical connection. Accordingly, if one device is coupled to another device, that connection may be through a direct electrical connection, or through an indirect electrical connection via other devices and connections.

Figure 1A:
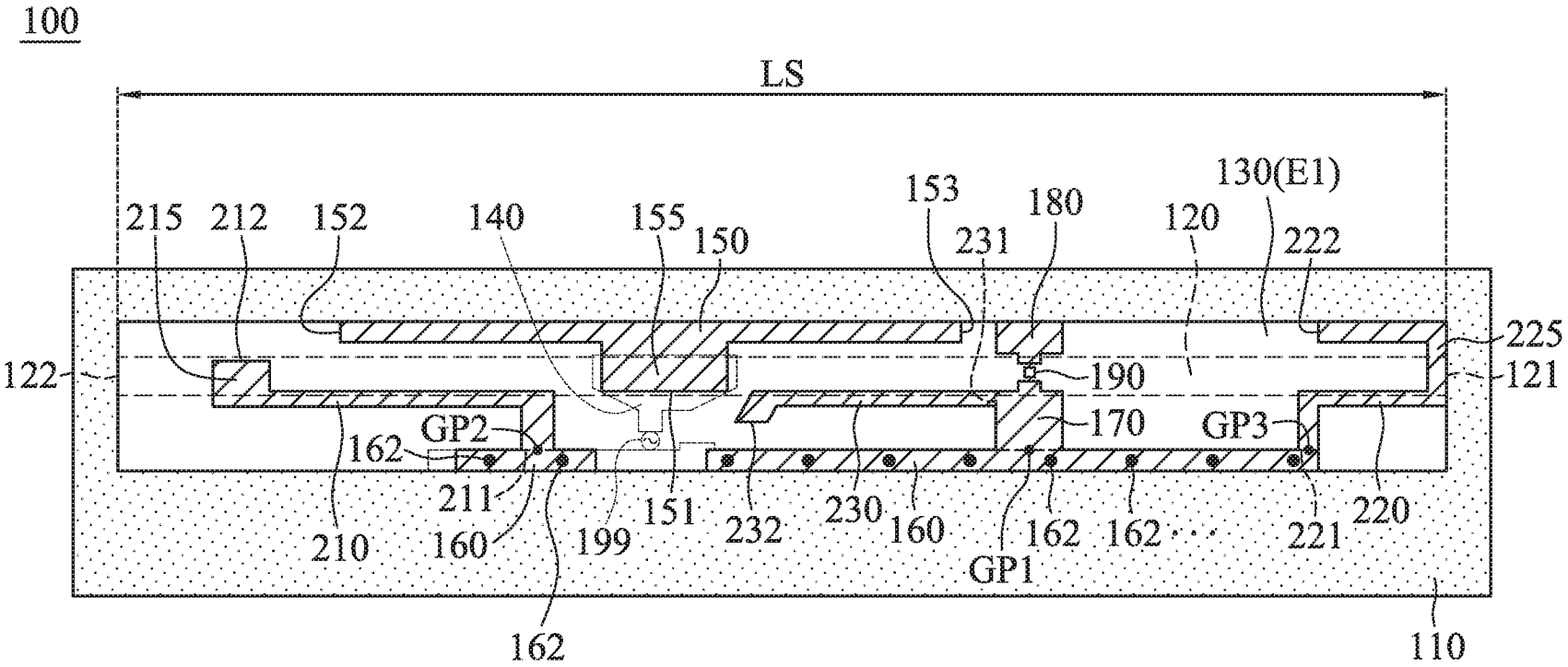
FIG. 1A is a top view of an antenna structure according to an embodiment of the invention.

FIG. 1A is a top view of an antenna structure 100 according to an embodiment of the invention. The antenna structure 100 may be applied to a mobile device, such as a smartphone, a tablet computer, or a notebook computer. As shown in FIG. 1A, the antenna structure 100 at least includes a metal mechanism element 110, a dielectric substrate 130, a feeding radiation element 140, a coupling radiation element 150, a ground plane 160, a first shorting element 170, a second shorting element 180, and a circuit element 190. The feeding radiation element 140, the coupling radiation element 150, the ground plane 160, the first shorting element 170, and the second shorting element 180 may all be made of metal materials, such as copper, silver, aluminum, iron, or their alloys.

The metal mechanism element 110 may be a metal housing of a mobile device. In some embodiments, the metal mechanism element 110 is a metal upper cover of a notebook computer, or a metal back cover of a tablet computer, but it is not limited thereto. For example, if the mobile device is a notebook computer, the metal mechanism element 110 may be the so-called "A-component" in the field of notebook computers. The metal mechanism element 110 has a slot 120. The slot 120 of the metal mechanism element 110 may substantially have a straight-line shape. Specifically, the slot 120 has a first closed end 121 and a second closed end 122 which are away from each other. The antenna structure 100 may also include a nonconductive material which fills the slot 120 of the metal mechanism element 110, so as to achieve the waterproof or dustproof function.

Figure 1B:
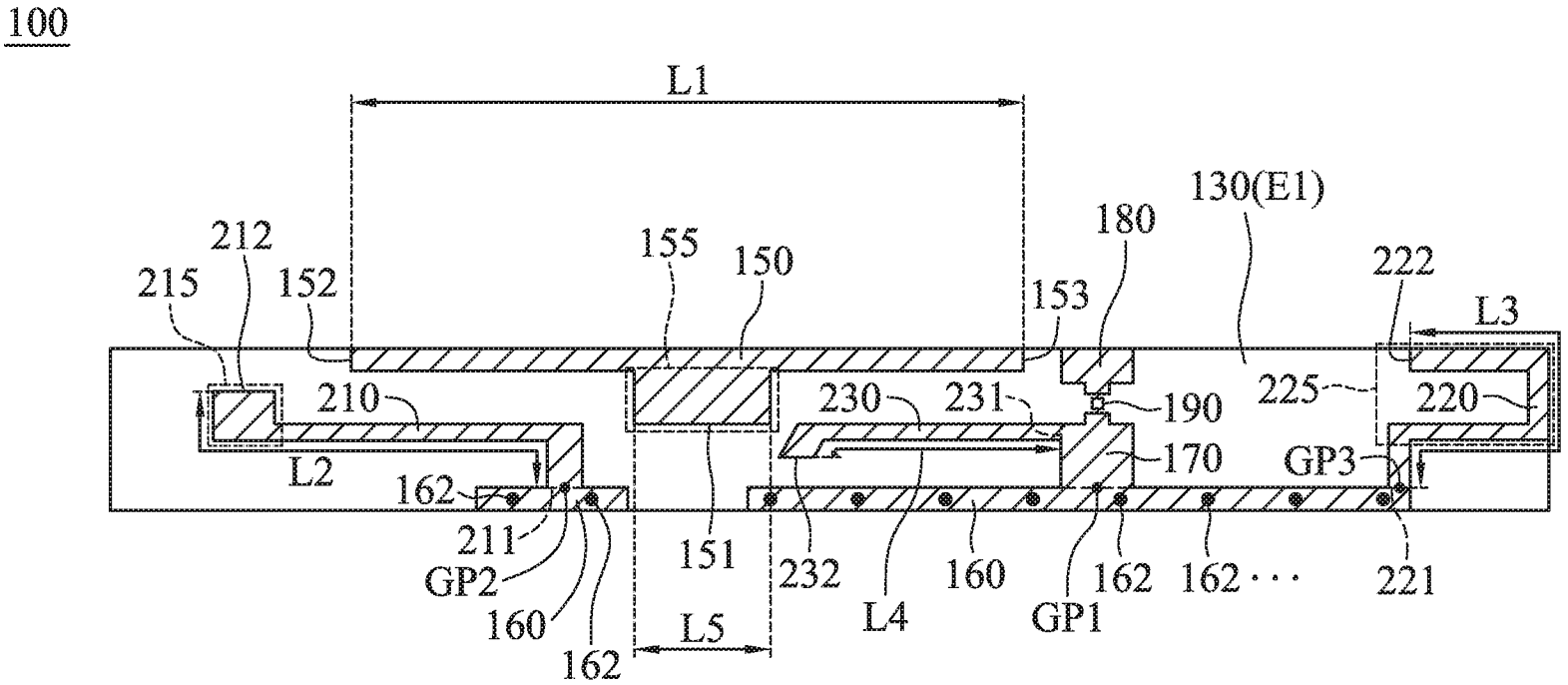
FIG. 1B is a top view of partial elements of an antenna structure on a first surface of a dielectric substrate according to an embodiment of the invention.
Figure 1C:
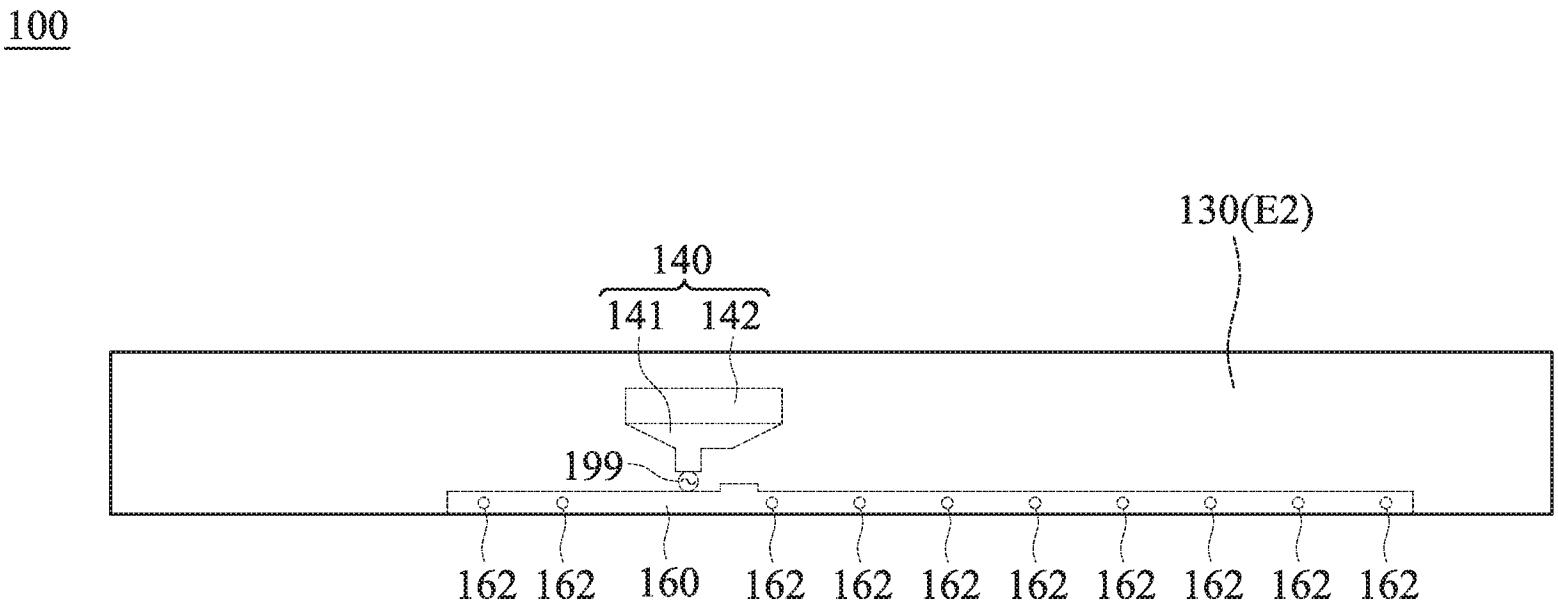
FIG. 1C is a see-through view of other partial elements of an antenna structure on a second surface of a dielectric substrate according to an embodiment of the invention.
Figure 1D:
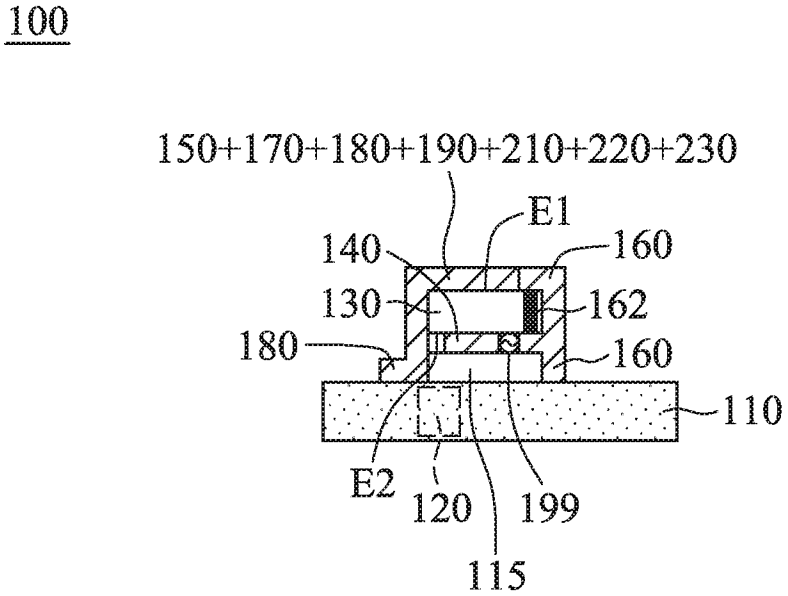
FIG. 1D is a side view of an antenna structure according to an embodiment of the invention.

The dielectric substrate 130 may be an FR4 (Flame Retardant 4) substrate, a PCB (Printed Circuit Board), or an FCB (Flexible Circuit Board). The dielectric substrate 130 has a first surface E1 and a second surface E2 which are opposite to each other. The second surface E2 of the dielectric substrate 130 is adjacent to the slot 120 of the metal mechanism element 110. It should be noted that the term "adjacent" or "close" over the disclosure means that the distance (spacing) between two corresponding elements is smaller than a predetermined distance (e.g., 5 mm or shorter), but often does not mean that the two corresponding elements directly touch each other (i.e., the aforementioned distance/spacing therebetween is reduced to 0). The coupling radiation element 150 is disposed on the first surface E1 of the dielectric substrate 130, and the feeding radiation element 140 is disposed on the second surface E2 of the dielectric substrate 130. Alternatively, the coupling radiation element 150 may be disposed on the second surface E2 of the dielectric substrate 130, and the feeding radiation element 140 may be disposed on the first surface E1 of the dielectric substrate 130. On the other hand, the first shorting element 170, the second shorting element 180, and the circuit element 190 may all be disposed on the first surface E1 of the dielectric substrate 130, or may all be disposed on the second surface E2 of the dielectric substrate 130. The two designs do not affect the performance of the invention. In some embodiments, the antenna structure 100 further includes a support element 115, which may be made of a nonconductive material, such as a plastic material. The support element 115 is disposed on the metal mechanism element 110, and is configured to support and fix the dielectric substrate 130 and all of the elements thereon. The support element 115 can prevent the feeding radiation element 140 from directly touching the metal mechanism element 110. It should be understood that the support element 115 is an optional element, which is omitted from other embodiments. FIG. 1B is a top view of partial elements of the antenna structure 100 on the first surface E1 of the dielectric substrate 130 according to an embodiment of the invention. FIG. 1C is a see-through view of other partial elements of the antenna structure 100 on the second surface E2 of the dielectric substrate 130 according to an embodiment of the invention (i.e., the dielectric substrate 130 is considered as a transparent element). FIG. 1D is a side view of the antenna structure 100 according to an embodiment of the invention. Please refer to FIG. 1A, FIG. 1B, FIG. 1C, and FIG. 1D together to understood the invention.

The feeding radiation element 140 may be a variable-width structure and include a narrow portion 141 and a wide portion 142. The wide portion 142 is coupled through the narrow portion 141 to a signal source 199. For example, the signal source 199 may be an RF (Radio Frequency) module for exciting the antenna structure 100. The feeding radiation element 140 extends across the slot 120. That is, the feeding radiation element 140 has a vertical projection on the metal mechanism element 110. The vertical projection of the feeding radiation element 140 at least partially overlaps the slot 120.

The coupling radiation element 150 may substantially have a T-shape. Specifically, the coupling radiation element 150 has a first end 151, a second end 152, and a third end 153, and includes a central widening portion 155. The central widening portion 155 may substantially have a large rectangular shape. The first end 151, the second end 152, and the third end 153 of the coupling radiation element 150 are all open ends. The central widening portion 155 is positioned at the first end 151 of the coupling radiation element 150. The coupling radiation element 150 is adjacent to the feeding radiation element 140. It should be noted that the coupling radiation element 150 is floating and does not directly touch the feeding radiation element 140. The coupling radiation element 150 has a vertical projection on the second surface E2 of the dielectric substrate 130, and the vertical projection of the coupling radiation element 150 at least partially overlaps the wide portion 142 of the feeding radiation element 140.

The ground plane 160 may substantially have a stepped-shape. For example, the ground plane 160 may be coupled through a copper foil, an aluminum foil, a conductive cloth, a screw lock, a spring, or a conductive sponge (not shown) to the metal mechanism element 110. Next, the ground plane 160 may extend from the metal mechanism element 110 onto the first surface E1 and the second surface E2 of the dielectric substrate 130. In some embodiments, the antenna structure 100 further includes one or more conductive via elements 162. The conductive via elements 162 can penetrate the dielectric substrate 130, and can be connected between the first surface E1 and the second surface E2 of the dielectric substrate 130.

The first shorting element 170 is coupled to a first grounding point GP1 on the ground plane 160. The second shorting element 180 is coupled to the metal mechanism element 110. The second shorting element 180 may substantially have another stepped-shape. For example, the second shorting element 180 may be coupled through a copper foil, an aluminum foil, a conductive cloth, a screw lock, a spring, or a conductive sponge (not shown) to the metal mechanism element 110. Next, the second shorting element 180 may extend from the metal mechanism element 110 onto the first surface E1 of the dielectric substrate 130. The circuit element 190 is coupled between the first shorting element 170 and the second shorting element 180. The circuit element 190 has a vertical projection on the metal mechanism element 110, and the vertical projection of the circuit element 190 is at least partially or completely inside the slot 120. In some embodiments, the circuit element 190 is a resistor, an inductor, a capacitor, a tuner IC (Integrated Circuit), or a combination thereof. For example, the aforementioned resistor may be a fixed resistor or a variable resistor, the aforementioned inductor may be a fixed inductor or a variable inductor, and the aforementioned capacitor may be a fixed capacitor or a variable capacitor. In addition, the aforementioned tuner IC may have the functions of switch and reactance adjustment.

In some embodiments, the antenna structure 100 further includes a first parasitic radiation element 210, which is made of a metal material and disposed on the first surface E1 of the dielectric substrate 130. In other embodiments, adjustments are made and the first parasitic radiation element 210 is disposed on the second surface E2 of the dielectric substrate 130. The performance of the invention is not affected. The first parasitic radiation element 210 may substantially have an N-shape. Specifically, the first parasitic radiation element 210 has a first end 211 and a second end 212. The first end 211 of the first parasitic radiation element 210 is coupled to a second grounding point GP2 on the ground plane 160. The second end 212 of the first parasitic radiation element 210 is an open end. The first parasitic radiation element 210 may further include a terminal widening portion 215. The terminal widening portion 215 may substantially have a small rectangular shape positioned at the second end 212 of the first parasitic radiation element 210. The terminal widening portion 215 of the first parasitic radiation element 210 has a vertical projection on the metal mechanism element 110, and the vertical projection of the terminal widening portion 215 may at least partially overlap the slot 120. It should be understood that the first parasitic radiation element 210 is an optional element, which is omitted from other embodiments.

In some embodiments, the antenna structure 100 further includes a second parasitic radiation element 220, which is made of a metal material and disposed on the first surface E1 of the dielectric substrate 130. In other embodiments, adjustments are made and the second parasitic radiation element 220 is disposed on the second surface E2 of the dielectric substrate 130. The performance of the invention is not affected. The second parasitic radiation element 220 may include a U-shaped portion 225. Specifically, the second parasitic radiation element 220 has a first end 221 and a second end 222. The first end 221 of the second parasitic radiation element 220 is coupled to a third grounding point GP3 on the ground plane 160. The second end 222 of the second parasitic radiation element 220 is an open end. The second end 222 of the second parasitic radiation element 220 and the third end 153 of the coupling radiation element 150 may substantially extend toward each other in opposite directions. The U-shaped portion 225 of the second parasitic radiation element 220 has a vertical projection on the metal mechanism element 110, and the vertical projection of the U-shaped portion 225 may at least partially overlap the slot 120. It should be understood that the second parasitic radiation element 220 is an optional element, which is omitted from other embodiments.

In some embodiments, the antenna structure 100 further includes a third parasitic radiation element 230, which is made of a metal material and disposed on the first surface E1 of the dielectric substrate 130. For example, the third parasitic radiation element 230 and the first shorting element 170 may be disposed on the same surface of the dielectric substrate 130. In other embodiments, adjustments are made and the third parasitic radiation element 230 is disposed on the second surface E2 of the dielectric substrate 130. The performance of the invention is not affected. The third parasitic radiation element 230 may substantially have an L-shape. Specifically, the third parasitic radiation element 230 has a first end 231 and a second end 232. The first end 231 of the third parasitic radiation element 230 is coupled to the first shorting element 170. The second end 232 of the third parasitic radiation element 230 is an open end, which is adjacent to the first end 151 of the coupling radiation element 150. The third parasitic radiation element 230 has a vertical projection on the metal mechanism element 110, and the vertical projection of the third parasitic radiation element 230 may at least partially overlap the slot 120. It should be understood that the third parasitic radiation element 230 is an optional element, which is omitted from other embodiments.

Figure 2:
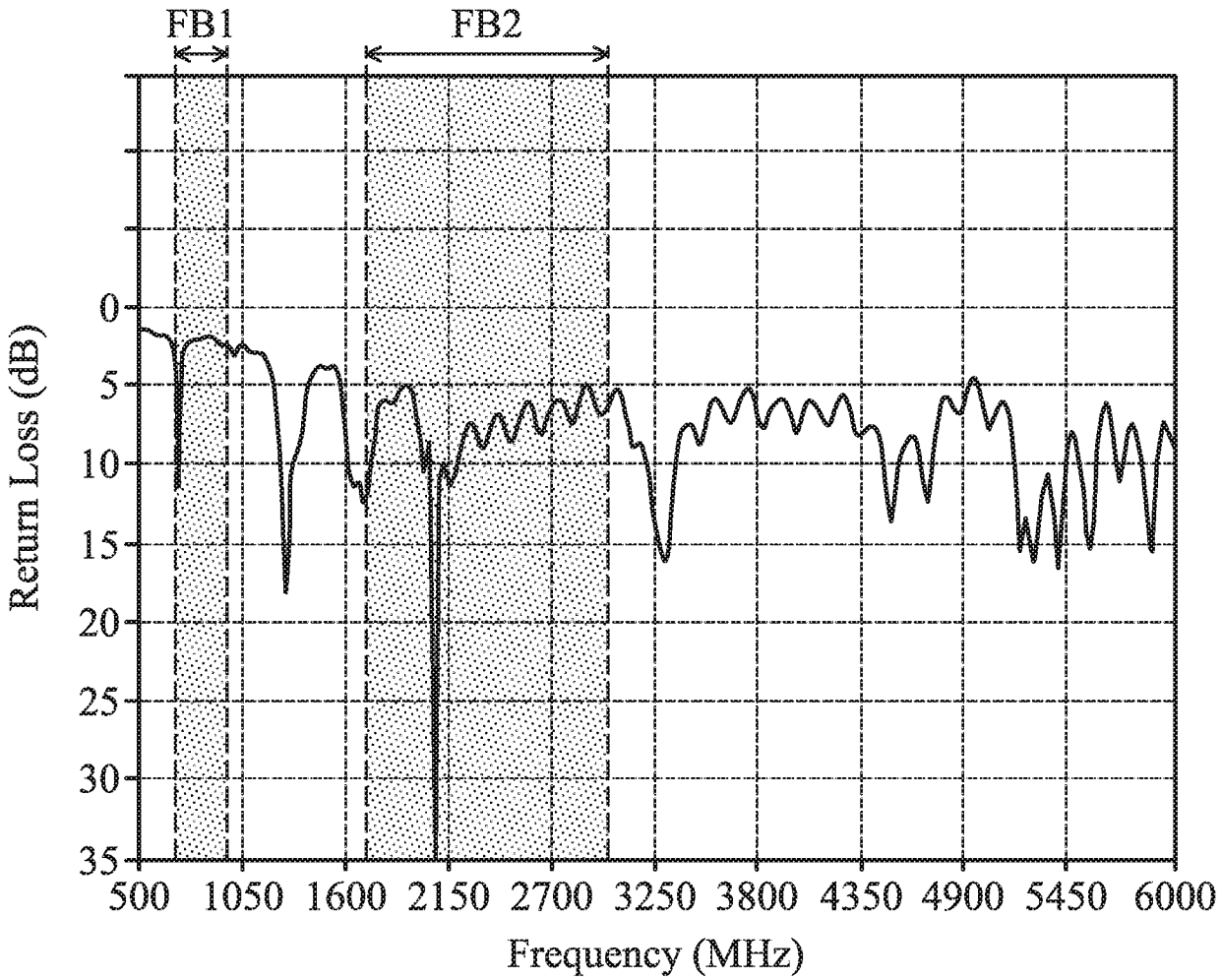
FIG. 2 is a diagram of return loss of an antenna structure according to an embodiment of the invention.

FIG. 2 is a diagram of return loss of the antenna structure 100 according to an embodiment of the invention. The horizontal axis represents operation frequency (MHz), and the vertical axis represents return loss (dB). According to the measurement of FIG. 2, the antenna structure 100 covers a first frequency band FB1 and a second frequency band FB2. For example, the first frequency band FB1 may be from 698 MHz to 960 MHz, and the second frequency band FB2 may be from 1710 MHz to 3000 MHz. Thus, the antenna structure 100 can support at least the multiband operations of LTE (Long Term Evolution).

With respect to the antenna theory, the feeding radiation element 140 and the slot 120 of the metal mechanism element 110 are excited to generate the first frequency band FB1 and the second frequency band FB2. The coupling radiation element 150 is configured to fine-tune the amount of frequency shift and the impedance matching of the first frequency band FB1. According to practical measurements, the incorporation of the circuit element 190 can increase the bandwidths of both of the first frequency band FB1 and the second frequency band FB2. When the circuit element 190 is implemented with a tunable element, the operation bandwidths of the first frequency band FB1 and the second frequency band FB2 can be further widened. In addition, the first parasitic radiation element 210, the second parasitic radiation element 220, and the third parasitic radiation element 230 are all configured to fine-tune the amount of frequency shift and the impedance matching of the second frequency band FB2.

In some embodiments, the element sizes of the antenna structure 100 are described as follows. The length LS of the slot 120 of the metal mechanism element 110 may be substantially equal to 0.5 wavelength ($\lambda/2$) of the first frequency band FB1 of the antenna structure 100. The length L1 of the coupling radiation element 150 may be from 0.25 to 0.5 wavelength ($\lambda/4\sim\lambda/2$) of the first frequency band FB1 of the antenna structure 100. The length L2 of the first parasitic radiation element 210 may be from 0.25 to 0.5 wavelength ($\lambda/4\sim\lambda/2$) of the second frequency band FB2 of the antenna structure 100. The length L3 of the second parasitic radiation element 220 may be from 0.25 to 0.5 wavelength ($\lambda/4\sim\lambda/2$) of the second frequency band FB2 of the antenna structure 100. The length L4 of the third parasitic radiation element 230 may be from 0.25 to 0.5 wavelength ($\lambda/4\sim\lambda/2$) of the second frequency band FB2 of the antenna structure 100. The ratio (L1/L5) of the coupling radiation element 150's length L1 to the central widening portion 155's length L5 may be from 2 to 8, such as about 5. The above ranges of element sizes are calculated and obtained according to many experiment results, and they help to optimize the operation bandwidth and impedance matching of the antenna structure 100.

Figure 3:
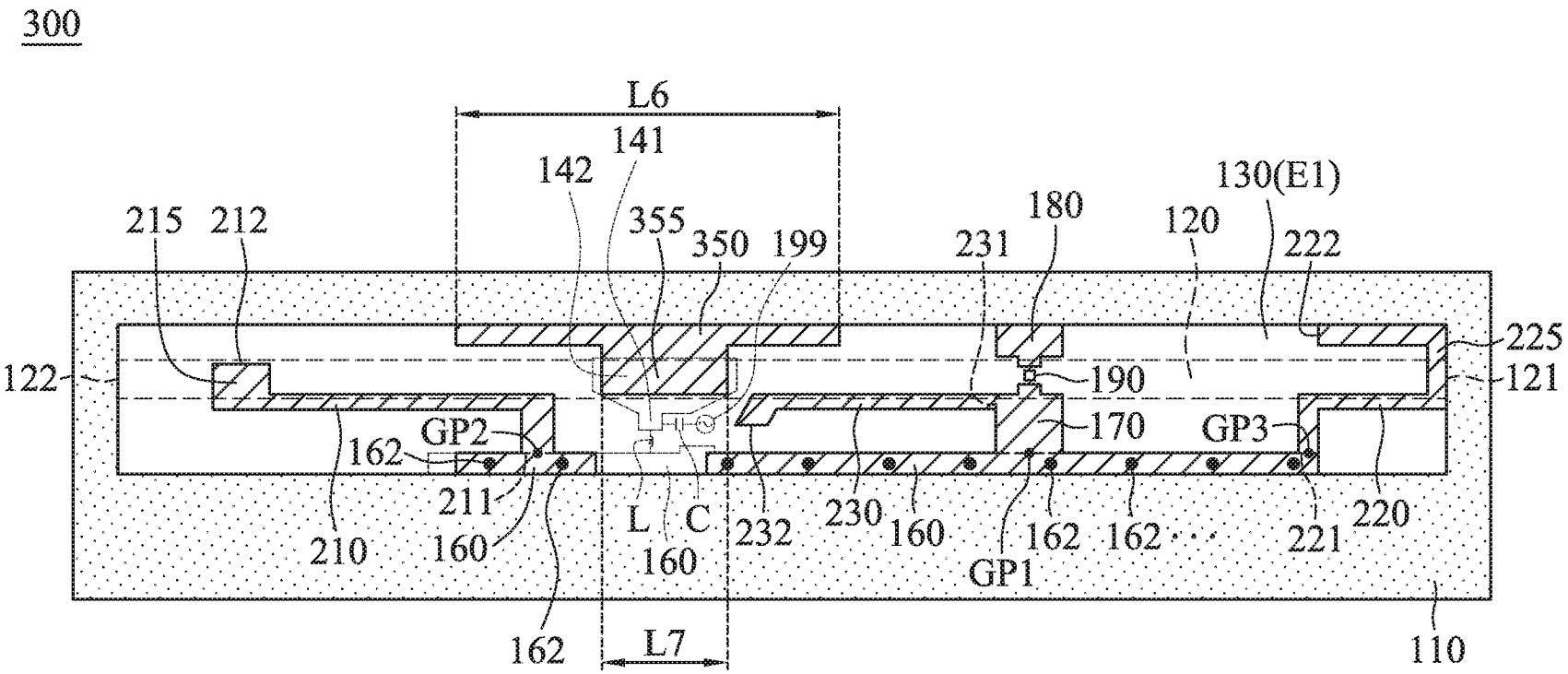
FIG. 3 is a top view of an antenna structure according to an embodiment of the invention.

FIG. 3 is a top view of an antenna structure 300 according to an embodiment of the invention. FIG. 3 is similar to FIG. 1A. In the embodiment of FIG. 3, the antenna structure 300 further includes a capacitor C and an inductor L. The capacitor C is coupled between the signal source 199 and the narrow portion 141 of the feeding radiation element 140. The inductor L is coupled between the narrow portion 141 of the feeding radiation element 140 and the ground plane 160. The capacitor C and the inductor L are configured to fine-tune the feeding impedance value of the antenna structure 300. In order to optimize the aforementioned feeding impedance value, the capacitance of the capacitor C may be greater than or equal to 5 pF, such as 6 pF, and the inductance of the inductor L may be greater than or equal to 6 nH, such as 10 nH. Other features of the antenna structure 300 of FIG. 3 are similar to those of the antenna structure 100 of FIGS. 1A, 1B, 1C and 1D. Accordingly, the two embodiments can achieve similar levels of performance.

Figure 4:
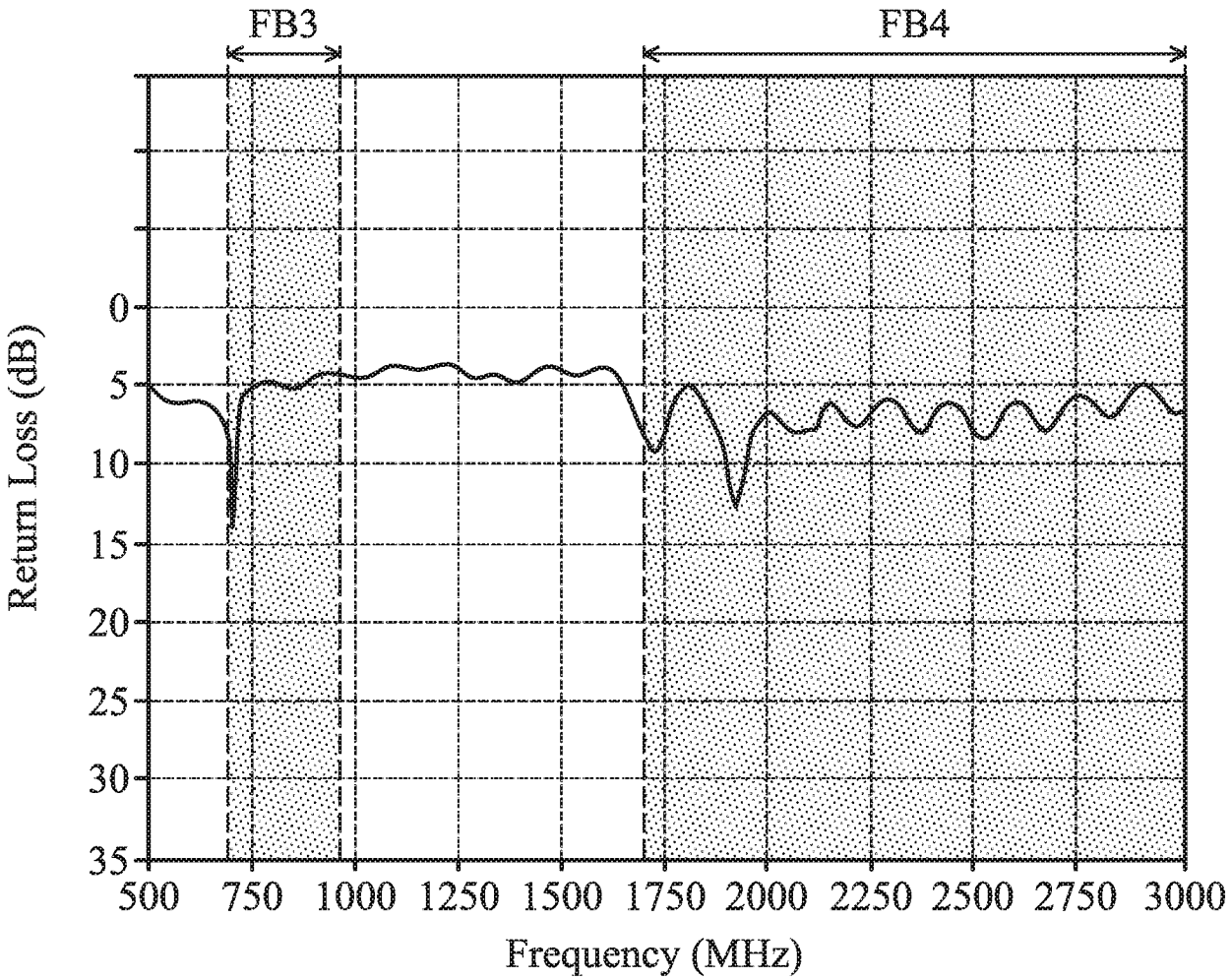
FIG. 4 is a diagram of return loss of an antenna structure according to an embodiment of the invention.

FIG. 4 is a diagram of return loss of the antenna structure 400 according to an embodiment of the invention. The horizontal axis represents operation frequency (MHz), and the vertical axis represents return loss (dB). According to the measurement of FIG. 4, the antenna structure 300 covers a first frequency band FB3 and a second frequency band FB4. For example, the first frequency band FB3 may be from 698 MHz to 960 MHz, and the second frequency band FB4 may be from 1710 MHz to 3000 MHz. Thus, the antenna structure 300 can support at least the multiband operations of LTE.

It should be noted that the sizes of a coupling radiation element 350 and its central widening portion 355 of the antenna structure 300 are further reduced after the capacitor C and the inductor L are included. For example, the length L6 of the coupling radiation element 350 may be shorter than or equal to 0.25 wavelength (λ/4) of the first frequency band FB3 of the antenna structure 300. The ratio (L6/L7) of the coupling radiation element 350's length L6 to the central widening portion 355's length L7 may be from 1.5 to 5.5, such as about 3. The above ranges of element sizes are calculated and obtained according to many experiment results, and they help to optimize the operation bandwidth and impedance matching of the antenna structure 300.

The invention proposes a novel antenna structure for integrating with a metal mechanism element of a mobile device. The metal mechanism element does not negatively affect the radiation performance of the antenna structure because the metal mechanism element is considered as an extension portion of the antenna structure. In comparison to the conventional design, the invention has at least the advantages of small size, wide bandwidth, and low manufacturing cost, and therefore it is suitable for application in a variety of mobile communication devices.

Note that the above element sizes, element shapes, element parameters, and frequency ranges are not limitations of the invention. An antenna designer can fine-tune these settings or values according to different requirements. It should be understood that the antenna structure of the invention is not limited to the configurations of FIGS. 1-4. The invention may merely include any one or more features of any one or more embodiments of FIGS. 1-4. In other words, not all of the features displayed in the figures should be implemented in the antenna structure of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

While the invention has been described by way of example and in terms of the preferred embodiments, it should be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An antenna structure, comprising:

a metal mechanism element, having a slot, wherein the slot has a first closed end and a second closed end;

a dielectric substrate, having a first surface and a second surface opposite to each other;

a feeding radiation element, coupled to a signal source, and extending across the slot;

a coupling radiation element, disposed adjacent to the feeding radiation element;

a ground plane, coupled to the metal mechanism element;

a first shorting element, coupled to a first grounding point on the ground plane;

a second shorting element, coupled to the metal mechanism element; and a circuit element, coupled between the first shorting element and the second shorting element;

wherein the coupling radiation element is disposed on the first surface of the dielectric substrate, and the feeding radiation element is disposed on the second surface of the dielectric substrate;

wherein the coupling radiation element is floating and does not directly touch the feeding radiation element;

wherein the antenna structure covers a first frequency band and a second frequency band;

wherein a length of the coupling radiation element is from 0.25 to 0.5 wavelength of the first frequency band;

wherein the antenna structure further comprises:

a first parasitic radiation element, disposed on the first surface or the second surface of the dielectric substrate, and coupled to a second grounding point on the ground plane, wherein the first parasitic radiation element comprises a terminal widening portion.

2. The antenna structure as claimed in claim 1, wherein the ground plane is a ground copper foil extending from the metal mechanism element onto the first surface and the second surface of the dielectric substrate.

3. The antenna structure as claimed in claim 1, wherein the feeding radiation element is a variable-width structure and includes a narrow portion and a wide portion.

4. The antenna structure as claimed in claim 3, wherein the coupling radiation element has a vertical projection on the second surface of the dielectric substrate, and the vertical projection of the coupling radiation element at least partially overlaps the wide portion of the feeding radiation element.

5. The antenna structure as claimed in claim 1, wherein the coupling radiation element substantially has a T-shape.

6. The antenna structure as claimed in claim 1, wherein the coupling radiation element comprises a central widening portion, and the central widening portion substantially has a large rectangular shape.

7. The antenna structure as claimed in claim 1, wherein the circuit element has a vertical projection on the metal mechanism element, and the vertical projection of the circuit element is completely inside the slot.

8. The antenna structure as claimed in claim 1, wherein the circuit element is a resistor, an inductor, a capacitor, or a tuner IC (Integrated Circuit).

9. The antenna structure as claimed in claim 1, wherein the first frequency band is from 698 MHz to 960 MHz, and the second frequency band is from 1710 MHz to 3000 MHz.

10. The antenna structure as claimed in claim 9, wherein a length of the slot is substantially equal to 0.5 wavelength of the first frequency band.

11. The antenna structure as claimed in claim 9, wherein the first parasitic radiation element substantially has an N-shape.

12. The antenna structure as claimed in claim 11, wherein the terminal widening portion substantially has a small rectangular shape.

13. The antenna structure as claimed in claim 11, wherein a length of the first parasitic radiation element is from 0.25 to 0.5 wavelength of the second frequency band.

14. The antenna structure as claimed in claim 9, further comprising:

a second parasitic radiation element, disposed on the first surface or the second surface of the dielectric substrate, and coupled to a third grounding point on the ground plane, wherein the second parasitic radiation element comprises a U-shaped portion.

15. The antenna structure as claimed in claim 14, wherein a length of the second parasitic radiation element is from 0.25 to 0.5 wavelength of the second frequency band.

16. The antenna structure as claimed in claim 9, further comprising:

a third parasitic radiation element, disposed on the first surface or the second surface of the dielectric substrate, and coupled to the first shorting element, wherein the third parasitic radiation element substantially has an L-shape.

17. The antenna structure as claimed in claim 16, wherein a length of the third parasitic radiation element is from 0.25 to 0.5 wavelength of the second frequency band.

18. The antenna structure as claimed in claim 1, further comprising:

a capacitor, coupled between the signal source and the feeding radiation element; and an inductor, coupled between the feeding radiation element and the ground plane.

* * * * *